US005555238A

United States Patent [19]

Miyazawa

[11] Patent Number: 5,555,238

[45] Date of Patent: Sep. 10, 1996

[54] INK SUPPLIER

[75] Inventor: Toshio Miyazawa, Shizuoka, Japan

[73] Assignee: Kabushiki Kaisha TEC, Shizuoka, Japan

[21] Appl. No.: 905,310

[22] Filed: Jun. 29, 1992

[30] Foreign Application Priority Data

Jul. 8, 1991 [JP] Japan ..... 3-166629

[51] Int. Cl.[6] ..... B41J 2/175

[52] U.S. Cl. ..... 347/86

[58] Field of Search ..... 347/85, 86, 87

[56] References Cited

U.S. PATENT DOCUMENTS 4,306,245 12/1981 Kasugayama et al. ..... 347/86

4,511,906 4/1985 Hara ..... 346/140 R 5,047,790 9/1991 Cowger et al. ..... 347/86

*Primary Examiner*—Benjamin R. Fuller

*Assistant Examiner*—Craig A. Hallacher

*Attorney, Agent, or Firm*—Oblon, Spivak, McClelland, Maier & Neustadt, P.C.

[57] ABSTRACT

In the present invention, draft holes are provided a the corners of an ink storage tank. The holes have diameters which enable them to hold ink inside the ink storage tank by the surface tension of the ink, and even when the position of the ink storage tank is changed to a different position, some of the draft holes can be positioned higher than the ink level. This makes it possible to communicate the inside of the ink storage tank with air and keeps the inside pressure at atmospheric pressure, whereby ink leakage through the draft hole is prevented. At the draft holes positioned lower than the ink level, the ink is held by the surface tension of the ink, thus preventing ink leakage through the draft holes.

9 Claims, 3 Drawing Sheets

INK SUPPLIER

FIELD OF THE INVENTION AND RELATED ART STATEMENT

The present invention relates to an ink supplier to be utilized for an ink jet printer.

There is an invention described in Japanese Patent Application Laid-open No. Sho 55-42877 as shown in FIGS. 3 and 4. A recording liquid storage 32 for storing recording liquid 31 is mounted in a cubicle 30, and in the upper part of the cubicle 30, there is provided a nozzle 35 which is connected to the recording liquid storage 32 through a supply tube 33 and surrounded by piezoelectric elements 34. Draft holes 37 and 38 communicating with the air are disposed on a upper surface of the cubicle 30 and on a partition 36 which is provided in the upper part of the recording liquid storage 32.

In such a recording head cartridge, the draft holes 37 and 38 are generally used in the positions opening upward as shown in FIG. 3, and the recording liquid in the nozzle 35 is compressed and jetted out by the application of a voltage to the piezoelectric elements 34. The recording liquid 31 in the recording liquid storage 32 is always communicated with the air through the draft holes 37 and 38 so that the recording liquid 31 is supplied to the nozzle 35 through the supply tube 33 each time the recording liquid is jetted out from the nozzle 35. Even when the cubicle 30 is fallen down and the draft holes 37 and 38 are positioned in a lower part, the recording liquid 31 is prevented from leaking out through the draft holes 37 and 38 by the surface tension of the recording liquid.

In the case of the invention described in Japanese Patent Application Laid-open No. Sho 55-42877, there can be a problem that if the cubicle 30 is left in a fallen state for a long time and if the air inside the recording liquid storage 32 is expanded by the rise of the ambient temperature, the recording liquid can leak out through the draft holes 37 and 38. Therefore, only the state of the use where the draft holes 37 and 38 are positioned upward can be selected, which causes a limit in the selection of layout of a printer.

OBJECTS AND SUMMARY OF THE INVENTION

A first object of the present invention is to prevent ink from leaking even in the case where an ink storage tank is fixed in any direction selected from a variety of directions.

A second object of the present invention is to prevent ink from leaking even in the case where an ink storage tank is moved toward any direction.

In the present invention, an ink storage tank connected to an ink reservoir having an ink jet means is provided and draft holes are disposed at a plurality of corners of the ink storage tank, the holes having specified diameters being able to hold the ink inside the storage tank by the surface tension of the ink, making the ink communicate with air, and at least the inner surfaces of the holes being formed of a water repellent material.

Since draft holes are disposed at respective corners of the ink storage tank, even when the storage tank is fixed in an arbitrary position, some of the draft holes can be positioned higher than the ink level, which makes it possible to communicate the inside of the ink storage tank with the air. In this case, although there are draft holes which are positioned lower than the ink level inside the ink storage tank, the pressure at a draft hole for holding the ink by the surface tension of the ink can be made higher than the pressure caused by the gravity of the ink, and moreover, even though the ink tank is fixed in any position, some draft holes can be positioned to make the air inside the ink storage tank communicate with the air, so that even if the air inside the ink storage tank is expanded by the rise of the ambient temperature, the inside pressure is not raised higher than the atmospheric pressure, whereby the ink leakage through a draft hole can be effectively prevented.

DETAILED DESCRIPTION OF PREFERRED EMBODIMENTS

Figure 1A:
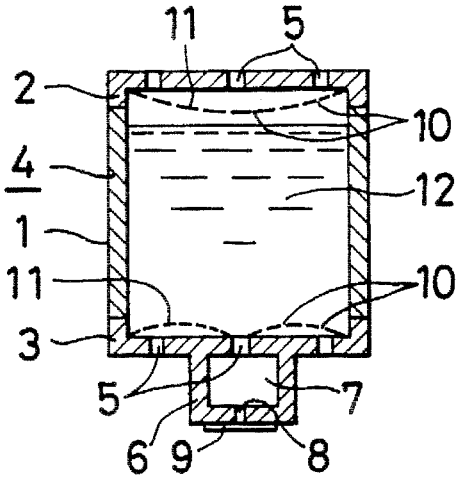
FIG. 1 is a longitudinal sectional side view showing an embodiment according to the present invention.

An embodiment according to the present invention will be explained based on FIGS. 1 and 2. As showing in FIG. 2, an ink storage tank 4 is formed of fixing lids 2 and 3 on both opening end surfaces of a main case 1 having a rectangular cylindrical shape. On the lids 2 and 3, a plurality of openings 5 are formed, respectively, and in the central part on the lid 3 on the lower side, a protruded part 6 having a rectangular cylindrical shape is formed.

Figure 1B:
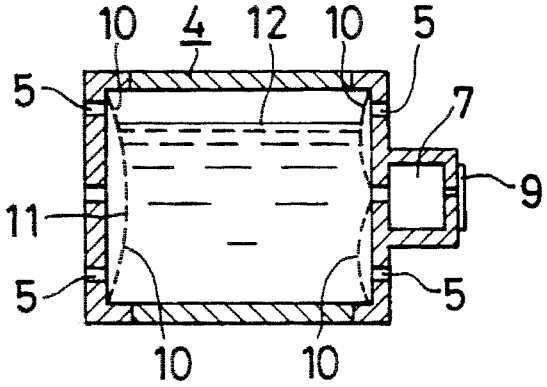
Figure 1C:
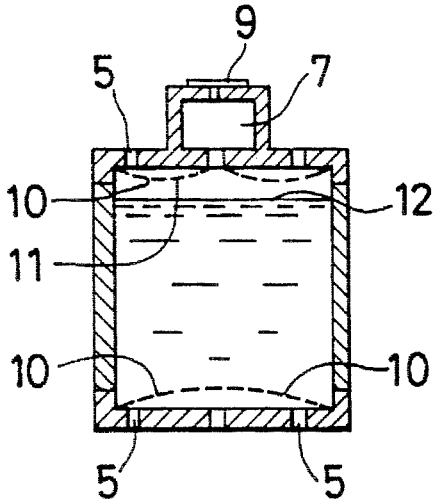
Figure 2:
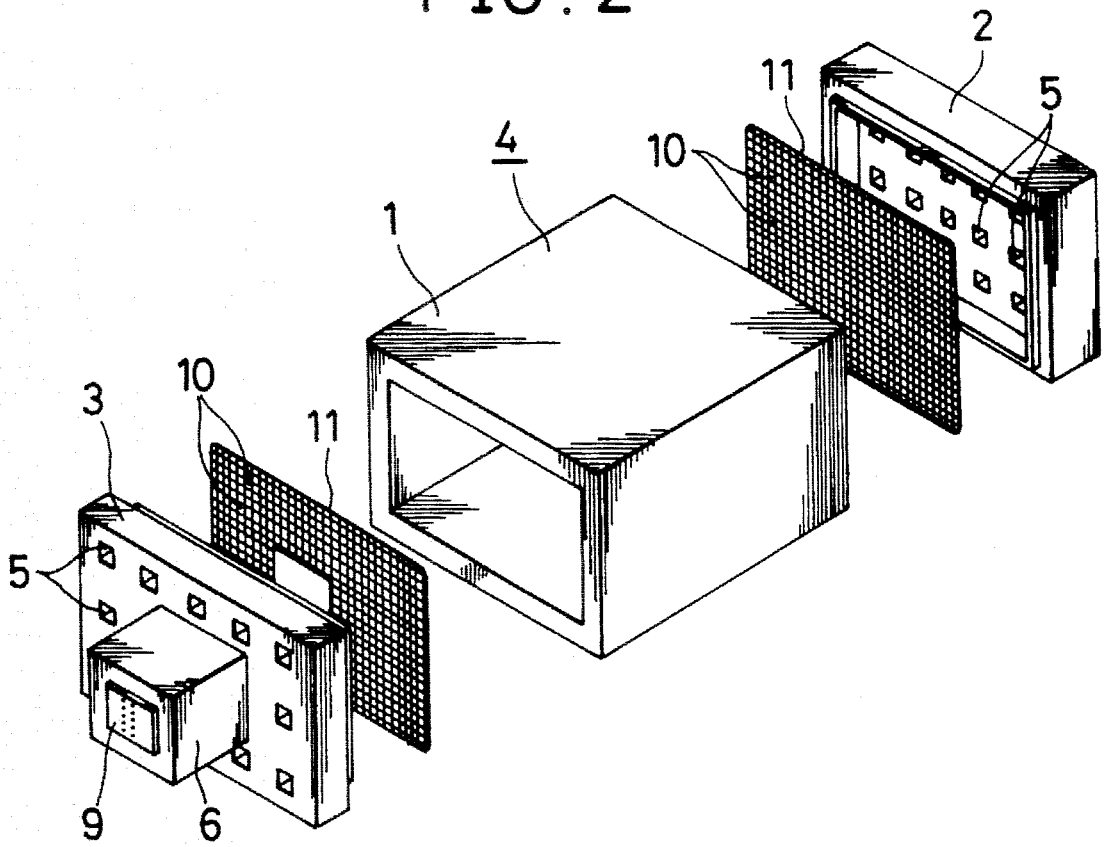
FIG. 2 is an exploded perspective view showing the embodiment of FIG. 1.
Figure 3:
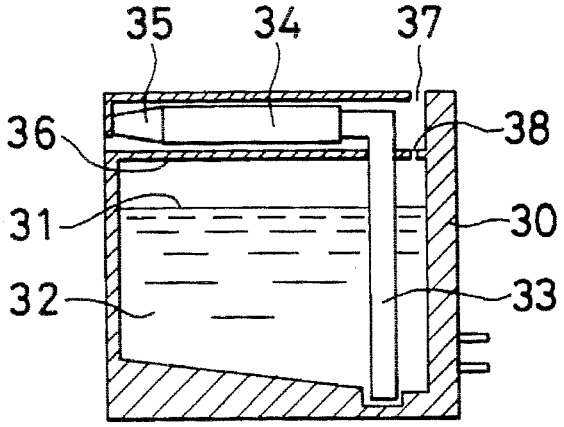
FIG. 3 is a longitudinal sectional side view showing a conventional example.
Figure 4:
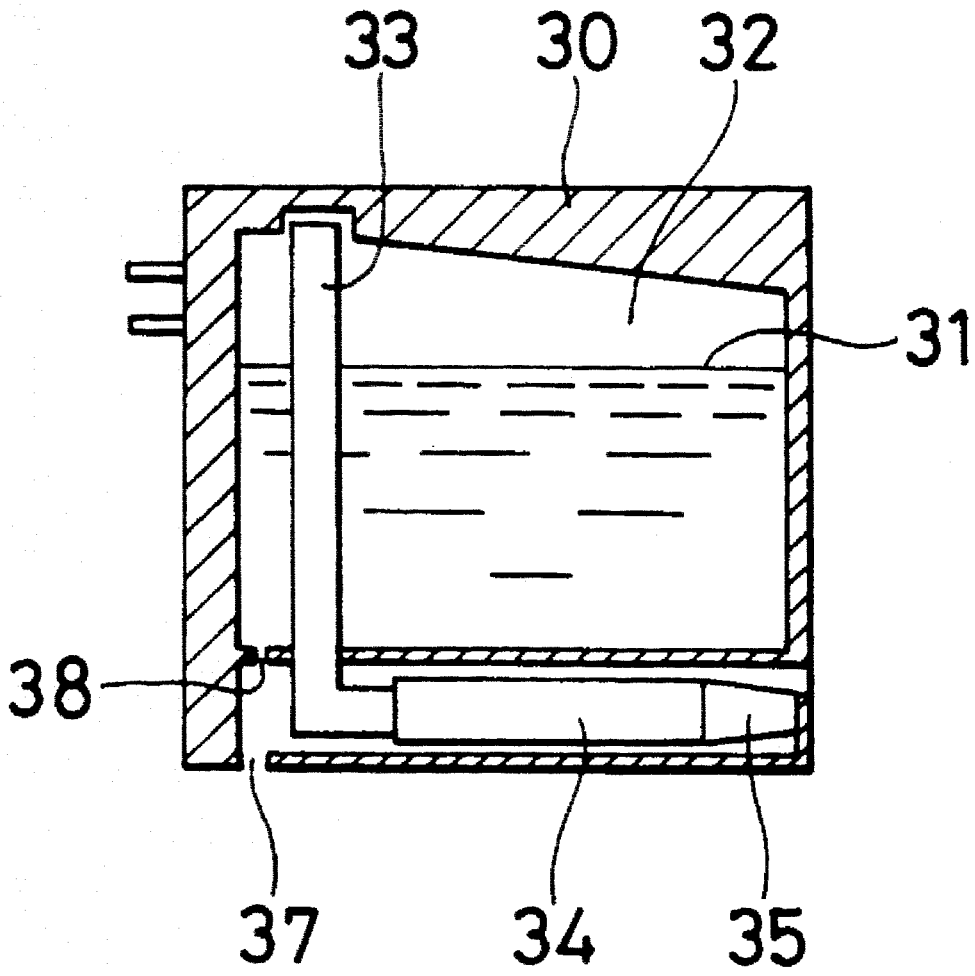
FIG. 4 is another longitudinal sectional side view of FIG. 3.

As showing in FIG. 1(*a*), inside the protruded part 6 is formed an ink reservoir 7, which is connected to the inside of the ink storage tank 4 through the openings 5. Under the ink reservoir 7, an ink passage 8 is formed, and on the tip of the protruded part 6, an ink jet means 9 is provided. The well-known ink jet means 9, not shown, is a means comprising a plurality of orifices connected to the ink passage 8 and heat generators to which a voltage is selectively applied and which is provided on the orifices.

On the upper and lower inner surfaces of the ink storage tank 4, meshes 11 having a large number of draft holes 10 are provided which hold the ink 12 inside the tank with the surface tension of the ink. The mesh 11 is formed of a material having an excellent water repellent character. A porous film of polytetrafluoroethylene (PTFL) or an electroformed nickel plate coated with fluororesin is used as a material for the mesh 11. As described above, on the bottom surface of the ink storage tank, the openings 5 are formed, and also the mesh 11 is provided. Although the weight of the ink 12 acts on the draft holes 10 of the mesh 11, the leakage of the ink 12 through the draft hole 10 is prevented by the surface tension of the ink 12 at the draft hole 10 on the mesh 11.

Assuming that:

D is a diameter of the draft hole 10, $\theta a$ is an advance contact angle between the inner surface of the draft hole 10 and the ink 12, $\sigma$ is the surface tension of the ink 12, $\rho$ is the density of the ink 12, q is the gravitational acceleration of the ink 12, and H is the height of the ink 12 in the ink storage tank 4, the pressure which can support the ink 12 by the surface tension of the ink 12 at the draft hole 10 can be expressed by $-(4\sigma\cos\theta a)/D$. Therefore, the value of the pressure is set to satisfy the following expression (1), that is, the value is set to be larger than the weight ($\rho$ gH) of the ink 12 in the ink storage tank 4.

$$\rho gH<-(4\sigma\cos\theta a)/D \quad (1)$$

When numerical values are substituted for these values as shown in the following: $\theta a=110$ degrees, $\sigma=73$ mN/m, $\rho=1000$ kg/m$^3$, H=30 mm, g=9.8 m/g$^2$, then $D<0.34\times10^{-3}$ m is obtained. In the above case, as characteristic values of the surface tension $\sigma$, the density $\rho$, the advance contact angle $\theta a$, etc., the characteristic values of water are used. The reason that values of water are used is that the characteristics of the ink 12 being dealt with are close to those of water.

In the constitution as described above, since the draft holes 10 are formed at respective corners of the ink storage tank 4, even if the ink storage tank 4 is fixed in any position, some of the draft holes 10 are positioned above the level of the ink 12 and the air inside the ink storage tank 4 can be made to communicate with the air as shown in FIGS. 1(*a*), 1(*b*) and 1(*c*). In this case, although there are some draft holes positioned lower than the level of the ink 12, the pressure holding the ink 12 by the surface tension of the ink 12 at the draft hole 10 can be made larger than the weight of the ink 12 inside the storage tank 4 by satisfying the expression (1), and moreover, even if the ink storage tank 4 is fixed in ay position, the inside of the ink storage tank can be made to communicate with the air, so that even when the air inside the ink storage tank 4 is expanded by the rise of the ambient temperature, the ink leakage through the draft hole 10 can be effectively prevented.

In the above-mentioned embodiment, a state where the mesh 11 having a water repellent characteristic is sued for obtaining draft holes 120 is explained. However, a similar object can be achieved by forming the lids 2 and 3 of a water repellent material and setting the sizes of openings 5 to satisfy the above-mentioned expression (1). In this case, the openings 5 correspond to the draft holes in the present invention. It is also possible to form the lids 2 and 3 of a material which is not water repellent and coat the inner peripheral surface of the openings 5 with a water repellent film. Moreover, it is also possible to form the lids 2 and 3 of fluororesin and to form the draft holes 10 by machining.

When only 2 or 3 draft holes are to be formed, it may not possibly be true to say that even when an ink storage tank is foxed in any position, at least one of the draft holes is always communicated with the air; however the degree of freedom in the selection of an installing direction of the tank is increased and a variety of kinds of use modes are possible.

In the present invention, an ink storage tank connected to an ink reservoir having an ink jet means is provided, and draft holes having at least their inner surfaces formed of a water repellent material and having their diameters designed to be able to hold the ink inside the ink storage tank by the surface tension of the ink are provided at least at every corner of the ink storage tank to communicate the inside of the ink storage tank with the air. Therefore, even if the ink storage tank is fixed in any position, some of the draft holes can be positioned higher than the ink level, which makes it possible to communicate the inside of the ink storage tank with the air in any case. In this case, there are some draft holes positioned lower than the ink level, however, it is possible to make the pressure for holding the ink by the surface tension of the ink at the draft hole higher than the weight of the ink, and moreover, even if the ink tank is fixed in any position, some draft holes can be always disposed in positions to make the inside of the ink tank communicate with the air, so that even if the air inside the ink storage tank is expanded by the rise of the ambient temperature, the inside pressure is not raised higher than the atmospheric pressure, whereby the ink leakage through the draft hole can be effectively prevented.

What is claimed is:

1. An ink supplier comprising: an ink storage tank for storing ink therein, said ink storage tank being connected to an ink reservoir having an ink jet means for ejecting ink from said ink storage tank; and draft holes provided at a plurality of corners of said ink storage tank, each of said draft holes having diameters which are sized to be able to hold ink inside said ink storage tank by a surface tension of the ink inside the ink storage tank, said draft holes communicating an inside of the ink storage tank with outside air.

2. An ink supplier comprising: an ink storage tank for storing ink therein, said ink storage tank being connected to an ink reservoir having an ink jet means for ejecting ink from said ink storage tank; and draft holes provided at a plurality of corners disposed on diagonal lines of said ink storage tank, each of said draft holes having diameters which are sized to be able to hold ink inside said ink storage tank by a surface tension of the ink inside the ink storage tank, said draft holes communicating an inside of the ink storage tank with outside air.

3. An ink supplier comprising: an ink storage tank for storing ink therein, said ink storage tank being connected to an ink reservoir having an ink jet means for ejecting ink from said ink storage tank; and draft holes provided at respective corners of said ink storage tank, each of said draft holes having diameters which are sized to be able to hold ink inside said ink storage tank by a surface tension of the ink inside the ink storage tank, said draft holes communicating an inside of the ink storage tank with outside air.

4. An ink supplier as defined in claim 1, wherein at least inner surfaces of said draft holes are formed of a water repellent material.

5. An ink supplier as defined in claim 2, wherein at least inner surfaces of said draft holes are formed of a water repellent material.

6. An ink supplier as defined in claim 3, wherein at least inner surfaces of said draft holes are formed of a water repellent material.

7. An ink supplier comprising:

an ink storage tank for storing ink therein, said ink storage tank being connected to an ink reservoir having an ink jet means by ejecting ink from said ink storage tank;

a first mesh positioned in said ink storage tank and provided at a first end of said ink storage tank, said first mesh comprising a plurality of first draft holes provided at a plurality of corners of said ink storage tank for communicating an inside of said ink storage tank without side air; and a second mesh positioned in said ink storage tank and provided at a second end of said ink storage tank at a position opposite said first end, said second mesh comprising a plurality of second draft holes provided at a plurality of corners of said ink storage tank for communicating the inside of said ink storage tank with outside air.

8. An ink supplier as defined in claim 7, wherein inner surfaces of said draft holes are formed of a water repellent material.

9. An ink supplier as defined in claim 7, wherein said first mesh and said second mesh are formed of a water repellent material.

* * * * *